United States Patent [19]

Leblanc

[11] Patent Number: 4,604,980

[45] Date of Patent: Aug. 12, 1986

[54] FUEL INJECTION PUMP

[75] Inventor: Jean Leblanc, Lyons, France

[73] Assignee: Robert Bosch GmbH, Stuttgart, Fed. Rep. of Germany

[21] Appl. No.: 709,957

[22] Filed: Mar. 8, 1985

[30] Foreign Application Priority Data

Apr. 5, 1984 [DE] Fed. Rep. of Germany ..... 3412834

[51] Int. Cl.[4] ..... F02M 41/00

[52] U.S. Cl. ..... 123/450; 123/458

[58] Field of Search ..... 123/450, 458, 459, 514, 123/510, 503, 500, 506

[56] References Cited

U.S. PATENT DOCUMENTS

| | | | |
|---|---|---|---|
| 2,765,741 | 10/1956 | Hageman | 123/450 |
| 2,935,062 | 5/1960 | Aldinger et al. | 123/450 |
| 3,752,138 | 8/1973 | Jaines | 123/450 |
| 4,478,188 | 10/1984 | Eheim | 123/450 |
| 4,499,883 | 2/1985 | Miyaki et al. | 123/450 |
| 4,531,491 | 7/1985 | Iiyama et al. | 123/450 |

FOREIGN PATENT DOCUMENTS

| | | | |
|---|---|---|---|
| 55171 | 6/1982 | European Pat. Off. | 123/450 |
| 192928 | 11/1983 | Japan | 123/450 |
| 2058947 | 4/1981 | United Kingdom | 123/450 |

*Primary Examiner*—Magdalen Y. C. Greenlief
*Attorney, Agent, or Firm*—Edwin E. Greigg

[57] ABSTRACT

A fuel injection pump is proposed in which the fuel metering takes place during the intake stroke of the pump pistons via a fuel supply line in which a switching valve is mounted, which is opened upon the onset of the intake stroke of the pump pistons, closes in the course of this intake stroke and with this closing point also determines the injection onset upon the ensuing supply stroke of the pump pistons. The quantity of fuel to be injected is then limited by means of a pump-guided control edge, which is disposed on an annular slide provided on a free end of the distributor of the fuel injection pump; when a first control opening on the distributor which communicates with the pump work chamber coincides with a second control opening on the annular slide, the pump work chamber is relieved. The diversion or gradual shutoff point is controlled in the course of the compression stroke movement of the pump pistons by means of the relative rotation of the working point of the second control opening. By simultaneously affecting the switching valve and an adjusting device of the annular slide, the injection can take place at any arbitrary portion of the cam lobe curve of the cam drive of the pump pistons, as long as the requirements for the correct injection instants are met.

12 Claims, 6 Drawing Figures

FUEL INJECTION PUMP

BACKGROUND OF THE INVENTION

The invention is based on a fuel injection pump as defined hereinafter. In a fuel injection pump of this kind known from German Offenlegungsschrift No. 31 28 975, a control groove which extends obliquely with respect to the distributor axis in the jacket face of the distributor is provided as the first control opening, cooperating with a mouth of the fuel supply conduit serving as the second control opening. The leading control edge of this control groove determines the end of fuel feeding by the pump pistons to the injection valves, while the fuel supply via the opened magnetic valve occurs in the zone where the oblique control edge coincides with the inlet opening of the fuel supply conduit. At the instant when the control groove coincides with the mouth of the fuel supply conduit, the magnetic valve in the fuel supply conduit has already opened. The end of fuel supply is varied by longitudinally displacing the distributor. In the known type of injection pump, the pump pistons are guided in bores leading radially toward the distributor and are actuated by a revolving cam drive. With the known apparatus, an arbitrary point for injection can be established in the course of the pumping stroke, by appropriately actuating the metering valve in the fuel supply conduit and by means of the adjusting device of the distributor, so that it is possible to regulate both the injection onset and the end of injection with variable injection quantities, as well as to set a predetermined rate of supply.

In the known apparatus, however, the entire distributor must be displaced for the sake of control purposes mentioned above, which necessitates an expensive coupling of the distributor with the drive of the fuel injection pump. Furthermore, the opportunities for providing transducers for feedback of the position at any given time of the control groove relative to the inlet opening of the fuel supply conduit are relatively limited in the known apparatus.

OBJECT AND SUMMARY OF THE INVENTION

The fuel injection pump according to the invention has the advantage over the prior art that the distributor can be axially fixed, and can also receive radial pistons which run on a cam ring, which is either fixed to the housing or is adjustable by means of injection adjusters. A pump construction with which a low structural height is attainable thus becomes possible. A further advantage is that a control intervention becomes possible at the end of the distributor protruding from its guide bore, at a twist-free part of this end. The end of injection can be controlled simply, in a manner which is readily accomplished by means of transducers.

In accordance with a further provision of the invention, the diversion is affected via the second control opening into a chamber of lower pressure immediately surrounding the end of the distributor, so that diversion losses are very slight. The fuel present in this chamber can furthermore be advantageously used for cooling an electromagnetic final control element. With a further provision of the invention, an independent adjustment of the onset of injection, for instance mechanically in a known manner, is attainable. The control device controlling the annular slide and the switching valve is thereby relieved in its functions. Nevertheless, with a fuel injection pump of this kind the injection phase can be shifted to an arbitrary portion of the cam lobe curve and the supply rate can be adjusted thereby.

In still another provision of the invention, an arrangement of transducers which is very simple and accurate in function is realized, enabling the exact control of the injection quantity and the instant of injection.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
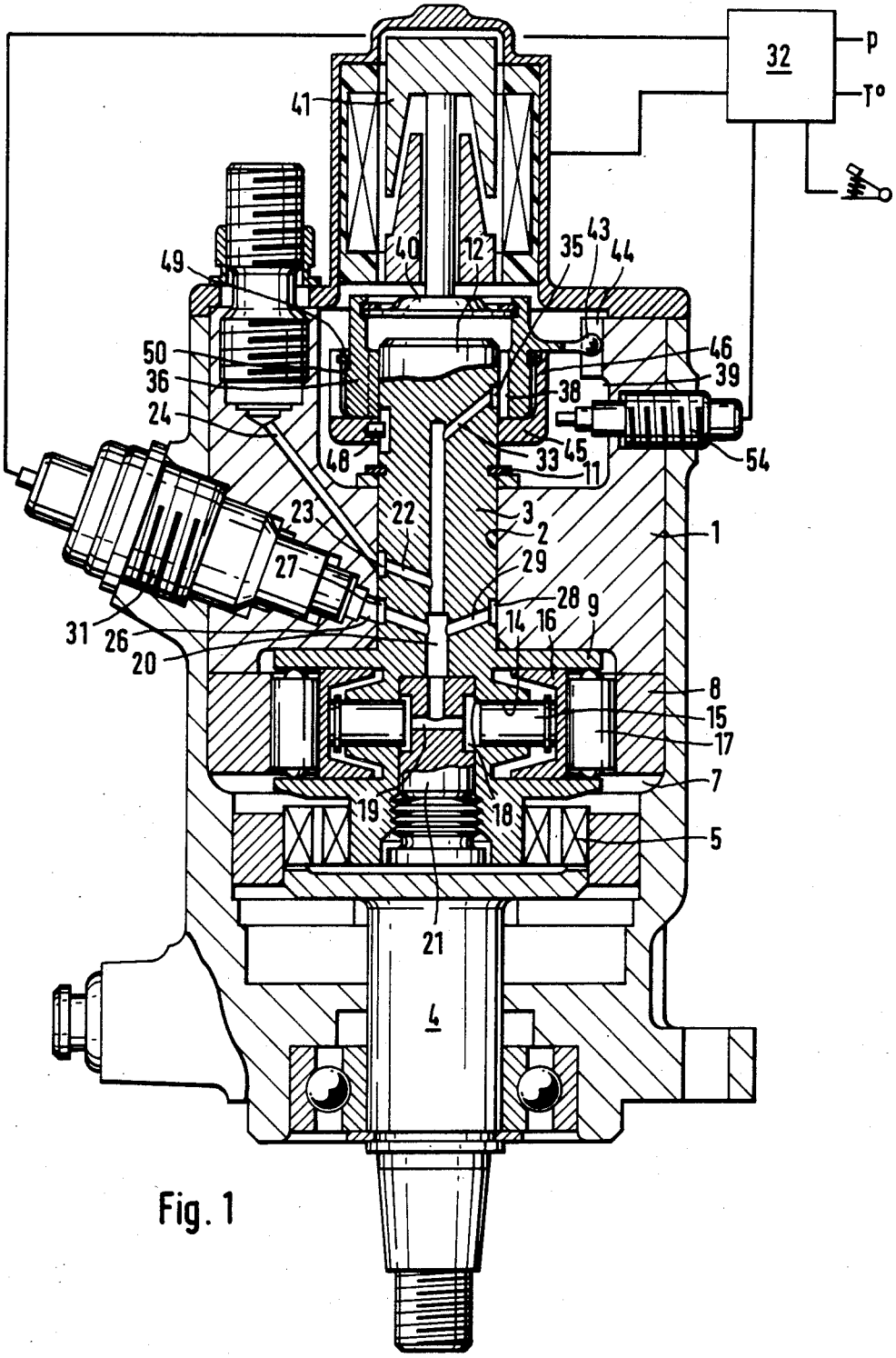
FIG. 1 is a simplified illustration of a first embodiment of a radial piston fuel injection pump.

In a housing 1 of a radial piston injection pump of the distributor type, a distributor 3 is supported in a cylindrical bore 2 and coupled with a fuel pump drive shaft 4 via a coupling 5. Between the coupling 5 and the bore 2, the housing 1 has an annular chamber 7, which is defined radially by a cam ring 8, which is of known construction and is provided with a cam track, and a collar 9 of the distributor 3 protrudes radially into this chamber 7. The distributor 3 is secured in its axial position on one end by the flank of the collar 9 resting on the housing 1 and on the other end by a retaining ring 11 on an end portion 12 of the distributor 3 that protrudes from the bore 2.

In the vicinity of the collar 9, four radial bores 14 are provided, spaced apart at equal angles, and four pump pistons 15 are guided tightly in them. As clearly shown in FIG. 1, each pump piston is confronted by a trackway 16, while the rollers 17 contact the outer surface of the trackway and in turn under the influence of centrifugal force, the rollers 17 remain in continuous contact with inner surface of the cam track provided by the cam ring 8 when the distributor rotates. Toward the inside, each pump piston 15 is adjoined by a pump work chamber 18, from which radial bores 19 preferably lead to a longitudinal conduit 20 in the distributor 3. The longitudinal conduit in turn ends in a plug 21 inserted into the distributor axially from the side having the coupling 5, and the radial bores 19 preferably extend within this plug 21. With the aid of this plug the dead space [or cylinder clearance] when the pump pistons 15 are at the position for the end of supply can be kept very small.

In the vicinity of the bore 2, a lateral conduit 22 branches off from the longitudinal conduit 20 and leads to a distributor opening 23, which as the distributor rotates communicates successively with various injection lines 24, distributed over the circumference of the bore 2, during the compression stroke of the pump pistons. The injection lines 24 are disposed in accordance with the number of cylinders of the associated internal combustion engine that are to be supplied with fuel and they lead to the various injection valves, not shown here.

Supplying the pump work chamber 18 is effected via a fuel supply line 26, which leads from a source of fuel, not shown, and discharges into the bore 2 at the inflow opening 27. The inflow opening is within the operating range of a plurality of inlet openings 28, which communicate via conduits 29 with the longitudinal conduit. The inlet openings are disposed in accordance with the number of injection lines, in the same distribution on the circumference of the distributor and come into contact, one after another, with the inflow opening 27 during the intake stroke of the pump pistons. An electrically controlled switching valve 31 by means of which the communication between the pump work chamber and the fuel supply source is controlled is inserted into the fuel supply line upstream of the inflow opening 27. The switching valve is triggered by means of a control unit 32.

Finally, a transverse conduit 33 also branches off from the longitudinal conduit 20 and leads to a first control opening 35 on the jacket face of the end portion 12 of the distributor 3. In the vicinity of control opening 35, an annular slide 36 is mounted on the end portion 12, said annular slide further having longitudinal grooves which act as a second control opening 38. These grooves are distributed over the inner jacket face of the annular slide 36 in accordance with the number and distribution of the fuel injection lines 24 to be supplied. The longitudinal grooves 38 extend over the entire width of the annular slide 36 and thus discharge at both ends into a fuel chamber 39 of low pressure. In this chamber, the fuel pressure of the fuel supply source, for instance, may prevail.

The annular slide 36 is coupled with an armature 40 of an adjusting magnet 41 and can be moved to various positions in the axial direction of the distributor 3 depending on the triggering of the magnet. The adjusting magnet, like the switching valve, is triggered by the control unit 32. The annular slide also has a guide element 43, the end of which engages a guide groove 44 in the vicinity of the housing radially surrounding the annular slide 36. The embodiment of the annular slide 36 may either be such that the guide groove 44 extends parallel to the axis of the distributor and the longitudinal grooves 38 have a curved course parallel to one another in a straight or non-straight line oblique to the distributor axis, as will be discussed below, or else, equivalently, such that the guide groove may extend obliquely while the longitudinal grooves extend axially parallel to one another. Another equivalent embodiment is a fuel injection pump which has, instead of one control opening 35, a plurality thereof corresponding to the number and distribution of injection lines, and therefore has only one second control opening 38 on the annular slide 36.

The mode of operation of the fuel injection pump will now be explained in further detail, referring to the diagram of FIG. 2.

Figure 2:
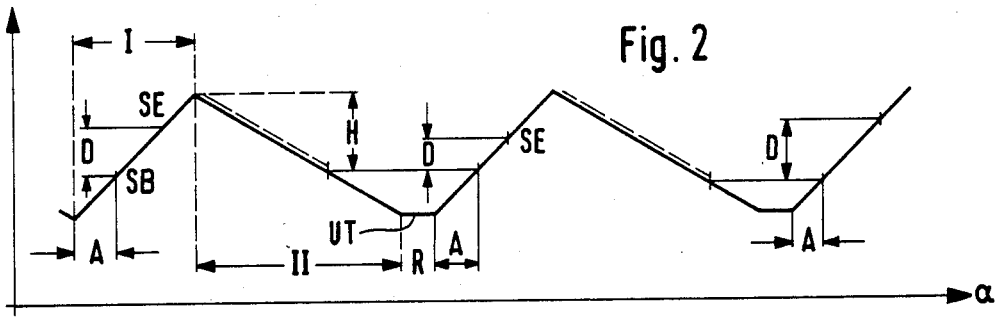
FIG. 2 is a diagram of a schematically shown cam lobe curve over the rotation angle $\alpha$ on which the locations of three different injection phases are indicated in the vicinity of the rising cam flanks.

FIG. 2 shows a portion of the cam lobe curve of the cam ring 8 in schematic form. The cam ring 8 is embodied as stationary, in the above-described example, and it has cams with a steep rising flank I, which is followed by a descending flank II the course of which is not so steep. After a brief halt R at bottom dead center UT, the next cam lobe then follows. At the end zones of the flanks in a known embodiment, the flanks indicated here by straight lines preferably actually have not abrupt but instead gradual slope transitions, while in contrast the actual working zone should in fact be linear. Such cams also may be equipped with working zones of varying slope, so that the quantity of fuel pumped by the pump piston per rotation angle, and hence the injection rate as well, can be varied. The pump pistons follow the contoured path plotted, in which the descending flank II extends as linearly as possible and with little slope, for the sake of improving the accuracy of metering.

Once the pump pistons 5 reach segment II, the switching valve 31 is opened, and the metering of fuel is effected over the period during which this valve is opened, corresponding to the dashed line in FIG. 2 over a portion of the descending cam flank; the size of this fuel quantity depends on the effective intake stroke H of the pump piston. The pump pistons rest against what will now be termed the roller tappets 16 and follow their outward movement. At the end of the stroke H, the pistons 15 stop, while the roller tappets continue to follow the cam track. At the next rising flank, they meet the piston 15 once again, and at this point, the angular interval A after bottom dead center, the injection of fuel begins (SB). In the course of further rotation, the first control opening 35 then comes to coincide with the second control opening 38, in fact at point SE, which stands for the end of injection. At this point, the pump work chamber is in fact suddenly relieved of pressure, and the remaining fuel pumped by the pump pistons is transferred to the fuel chamber 39.

Now if the annular slide 36 is adjusted at the same time the switching valve 31 is triggered, the end of injection can be shifted to an earlier or later point on the cam elevation curve, which is shown in the remaining curve course of FIG. 2. However, the injection quantity is then varied as well. Consequently, with this embodiment the injection quantity is controlled by the annular slide 36, given an onset of injection adapted to operating conditions. An rpm-dependent variation of the injection onset, for instance, is taken into account by the control unit 32 in controlling the annular slide 36.

However, it is equally possible to control the end of injection by keeping the position of the annular slide 36 substantially constant, optionally in accordance with peripheral parameters, and in order to vary the quantity control time of the switching valve 31 is varied.

Figure 3:
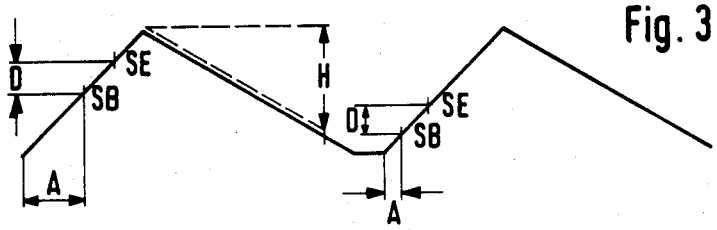
FIG. 3 is a diagram corresponding to FIG. 2 in which a variation of both the injection onset and the end of injection for varying the supply rate is shown.

FIG. 3 shows a third possibility for utilizing various portions of the cam lobe curve as a zone affecting fuel supply, for instance with the injection quantity D remaining the same. To do this, both the position of the annular slide and the switching time of the switching valve 31 must be varied.

The embodiment of the control unit is such that it receives signals relating both to the desired load and to peripheral parameters such as temperature and pressure, from which the injection quantity as well as the instants of injection and the injection rate are to be determined. Preferably, parameter-dependent performance graphs are specified to that end. Embodying a control unit of this kind is within the scope of control concepts already worked out for other injection systems and therefore need not be described in further detail here.

Figure 4:
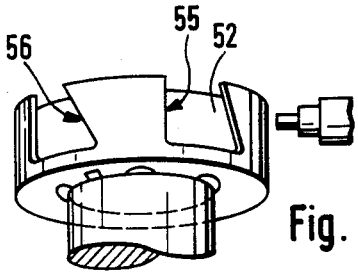
FIG. 4 is a perspective view of an annular transducer element used in the embodiment of FIG. 1.

The control unit preferably operates with feedback of the end of injection, at which the first control opening 35 comes to coincide with the second control opening 38. To this end, a transducer element 45 is provided on the end portion 12, the transducer being embodied in the form of a cup with a cylindrical wall. This transducer element 45 is coupled in the direction of rotation with the distributor 3 via a pin 48 and in the axial direction is coupled with the annular slide 36 via a retaining ring 49 on the inside of the transducers cylindrical wall 46 and via a shoulder 50 of the annular slide 36. The cylindrical wall 46 surrounds the annular slide 36 and has recesses 52 shown in FIG. 4 on its outer surface. The recesses 52 are distributed over the outer circumference in accordance with the number of second control openings 38 and are associated with a fixed transducer element 54 in such a way that upon an overlap of a first limiting edge 55 of the recess 52, the onset of intake by the pump pistons 15 takes place, and upon the overlap of a second limiting edge 56 of the recess, the point for opening the first control opening 35 occurs, at the end of injection. The first limiting edge 55 is axially parallel, in accordance with the fixed relationship between the cam lobe and the rotation angle position of the distributor, while when the annular slide 36 is adjusted the second limiting edge 56 follows the course of the rotational direction of the working point of the second control opening 38 relative to the first control opening 35.

The advantages of the exemplary embodiment described above are that an adjustment of the cam ring 8 can be dispensed with, and the injection adjustment is effected solely via the switching valve 31 or the adjusting magnet 41. In controlling the injection, only the one descending flank of the switching valve 31 has to be taken into account as a factor of inaccuracy. As is well known, magnetic valves for instance have switching times that remain the same regardless of the rpm with which the pump is operated, so that via this finite switching time an rpm error occurs in the process of metering. If the fuel metering quantity is determined solely by a magnetic valve, then rising and descending flanks in this direction have a negative effect, and futhermore, a still more pronounced delay results with the rising flank. The descending flanks of the magnetic valves are generally steeper. Advantageously, this pump has a pump-guided control edge synchronized in terms of rpm, in order to determine the other extreme value of the injection, to prevent errors in metering caused thereby.

The gradual shutoff, or fuel diversion, characteristic at the second control opening can be varied both by means of the control unit 32 and by means of the course of the longitudinal grooves or guide grooves along the length of the annular slide adjusting stroke. A high output, that is, supply rate per stroke with a small dead space, is attained by disposing four pump pistons in the vicinity of the collar 9, which are defined on the inner end by the plug 21. In this manner, as well as with the stationary cam ring supported by the housing, a high feed or supply rate, which becomes necessary for direct fuel injection in internal combustion engines, can be attained. By separating the roller tappet referred to hereinafter from the pump piston, the masses that must be accelerated at the onset of injection are reduced considerably, and the strain on the cam track is thereby reduced as well.

Figure 5:
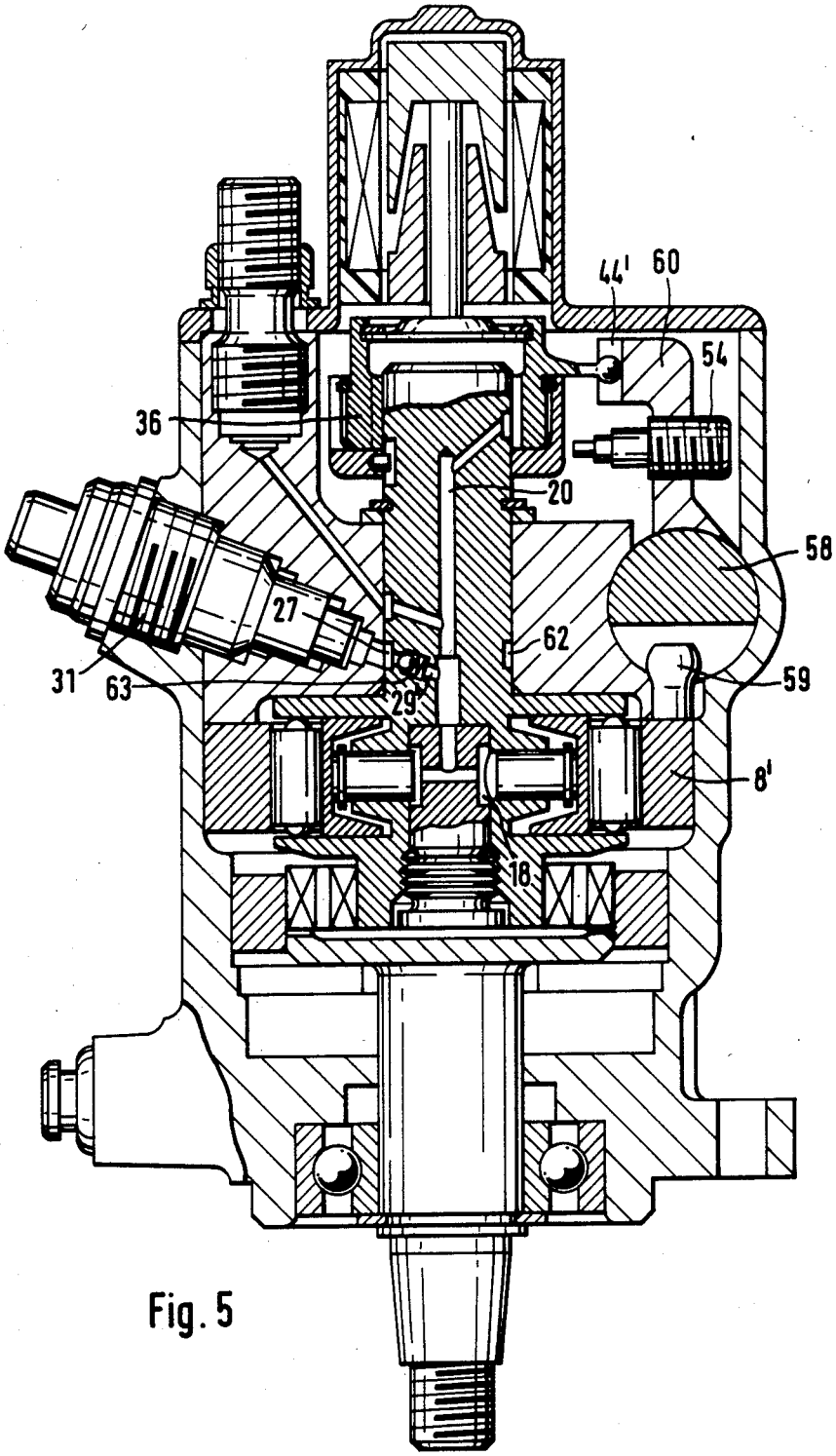
FIG. 5 shows a second exemplary embodiment, in which in contrast to the exemplary embodiment of FIG. 1 the cam ring is rotatable by means of an injection onset adjuster.

If an adjustment of injection onset over wide ranges, which is no longer economically or technically feasible by means of a long cam stroke, is necessary, then an injection adjuster for adjusting the cam ring in a known manner can be realized in accordance with the embodiment of FIG. 5. In the pump shown here, which is otherwise identical in principle to that shown in FIG. 1, an injection onset adjusting piston 58 is now provided, which in a conventional embodiment can be adjusted counter to the restoring force of a spring, by means for instance of fuel pressure, at a pressure level which is variable in accordance with rpm. The injection adjusting piston is coupled via a tang 59 with the roller ring 8'. A coupling member 60 also begins at the injection adjusting piston, and its end facing the annular slide 36 carries the guide groove 44'. Also disposed on the coupling member is the stationary transducer element 54. In an adjustment of the injection onset in which the cam ring 8' is rotated, a rotation of the annular slide 36 also takes place, in a given stroke position, in this embodiment. The first transducer element 54 simultaneously follows this adjustment as well. Superimposed on this basic adjustment, it is accordingly possible to perform all the operations already described in conjunction with the exemplary embodiment of FIG. 1.

Figure 6:
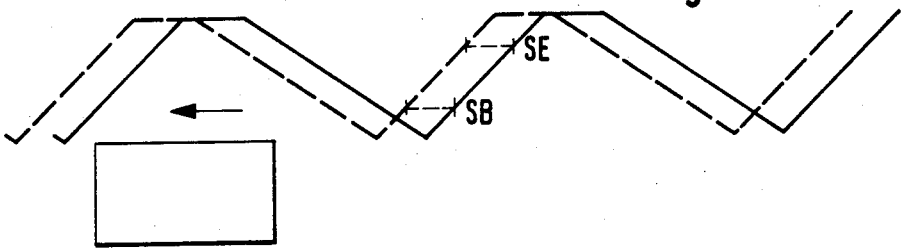
FIG. 6 is a diagram relating to the second exemplary embodiment and showing the shift in injection onset.

FIG. 6 illustrates a basic displacement of this kind in the vicinity of the cam ring, in which, beginning with a first setting corresponding to the solid line, the injection onset has been shifted toward an earlier point as indicated by the dashed line. The injection onset SB and the end of injection SE, with respect to the cam lobe course itself, have not been affected by this provision. The location of the bold solid line between SB and SE, the injection zone, can be varied in accordance with the embodiment illustrated by FIGS. 2 and 3. With an embodiment of this kind, it is possible, for instance, to perform a basic injection onset adjustment in accordance with the rpm and to take corrective measures, for instance via the control unit 32. This can be highly advantageous, and for instance it shortens the control stroke to be furnished by the control unit 32 for the control variable that is to be established. This makes the regulation faster.

The supply of fuel to the pump work chambers 18 via the switching valve 31 can also be effected via an external annular groove 62, which is in continuous communication with the inflow opening 27. Then, however, a check valve 63 opening toward the pump work chamber is disposed in the conduit 29' leading to the longitudinal conduit 20, and when the pump pistons are pumping this check valve 63 prevents pumping pressure from being imposed on the switching valve. An embodiment of this kind is particularly advantageous in the case of large injection onset adjusting ranges, because in that case it is no longer necessary to pay special attention to the accuracty of the coincidence of the inflow opening 27 with the inlet openings 28.

The control principle described here in terms of a radial piston pump is generally applicable to other pump types as well, for instance those in which the pump pistons and the distributor are separate from one another.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump having a housing, a bore in said housing at least one pump work chamber defined by a pump piston driven via a cam track, a distributor in said bore a pump work chamber in continuous communication with an opening provided in a jacket face of said distributor which rotates in said bore and is coupled with a drive shaft, said pump work chamber thereby being arranged to communicate during any given supply stroke of the pump piston successively with one of a plurality of injection lines distributed about the circumference of said bore via a longitudinal conduit in said distributor, said pump work chamber further being in continuous communication with a first control opening in said jacket face of said distributor, wherein the said first control opening is arranged to communicate with means having a second control opening and positioned adjacent to said jacket face of said distributor, said means adapted to communicate with a low fuel pressure chamber, an electrically controlled switching valve connected with a fuel supply line extending from a fuel supply, said electrically controlled switching valve controlling flow of fuel from said fuel supply line through said switching valve to said longitudinal conduit in said distributor during each cycle of operation and also communicate with said pump work chamber during the intake stroke of at least one pump piston, a control unit means for controlling said electrically controlled switching valve whereby said switching valve is opened no later than the beginning of the intake stroke of said pump piston and is closed at the end of a metering stroke to thereby determine the filling quantity of the work chamber prior to the onset of the supply stroke and said distributor further including an end means arranged to protrude out of said bore, said end means including said first control opening, an annular slide encompassing said first control opening and including said second control opening, and means for adjusting said annular slide and said first control opening.

2. A fuel injection pump as defined by claim 1, further wherein said annular slide is coupled with an electrically actuatable adjusting device.

3. A fuel injection pump as defined by claim 1, further wherein said second control opening further includes a groove which is arranged to discharge directly into said low pressure chamber.

4. A fuel injection pump as defined by claim 2, further wherein said second control opening further includes a groove which is aranged to discharge directly into said low pressure chamber.

5. A fuel injection pump as defined by claim 3, further wherein said groove extends parallel to said distributor axis and further that means are arranged to guide said annular slide in a substantially stationary guide track to generate a rotational movement thereof during reciprocation of said annular slide.

6. A fuel injection pump as defined by claim 3, further wherein said groove is arranged to extend obliquely relative to the axis of said distributor and further that said annular slide during reciprocation is retained in a fixed rotational position with a guide means via a substantially stationary guide track.

7. A fuel injection pump as defined by claim 4, further wherein said guide track is coupled with said cam track and said cam track is rotatable by means of an injection onset adjusting device.

8. A fuel injection pump as defined by claim 5, further wherein said guide track is coupled with said cam track and said cam track is rotatable by means of an injection onset adjusting device.

9. A fuel injection pump as defined by claim 4, further wherein said control device is connected to a first transducer for the onset of intake of said pump piston and is further connected to another transducer for the rotational positioning of said second control opening.

10. A fuel injection pump as defined by claim 5, further wherein said control device is connected to a first transducer for the onset of intake of said pump piston and is further connected to another transducer for the rotational positioning of said second control opening.

11. A fuel injection pump as defined by claim 6, further wherein said control device is connected to a first transducer for the onset of intake of said pump piston and is further connected to another transducer for the rotational positioning of said second control opening.

12. A fuel injection pump as defined by claim 9, further wherein one common, first transducer element is arranged to actuate a transducer ring coupled with said annular slide and said distributor, said transducer ring having first axially parallel control edges and second control edges the course of which corresponds to the curve resulting from the displacement of the part of the second control opening that is effective with respect to said first control opening upon the adjustment of said annular slide, further wherein said first control edges and said second control edges correspond in number and distribution to the pumping strokes of said pump piston taking place per rotation of said distributor, and further that orientation of said first and second control edges said first transducer element is such that the intake stroke of said pump piston begins upon the coincidence with said first transducer element, or the coincidence of said first control opening with said second control opening.

* * * * *